US007806817B2

(12) United States Patent
Day et al.

(10) Patent No.: US 7,806,817 B2
(45) Date of Patent: Oct. 5, 2010

(54) PROCESS FOR MAKING FILTER TOW

(75) Inventors: Craig Day, Derby (GB); John Travers, Derby (GB)

(73) Assignee: Acetate Products Ltd., Derby (GB)

( * ) Notice: Subject to any disclaimer, the term of this patent is extended or adjusted under 35 U.S.C. 154(b) by 591 days.

(21) Appl. No.: 10/591,961

(22) PCT Filed: Mar. 8, 2005

(86) PCT No.: PCT/GB2005/000878

§ 371 (c)(1),
(2), (4) Date: Jul. 20, 2007

(87) PCT Pub. No.: WO2005/084466

PCT Pub. Date: Sep. 15, 2005

(65) Prior Publication Data

US 2007/0272261 A1 Nov. 29, 2007

(30) Foreign Application Priority Data

Mar. 8, 2004 (EP) ..... 04251322

(51) Int. Cl.
*B31C 99/00* (2009.01)
*A24D 3/06* (2006.01)

(52) U.S. Cl. ..... 493/47; 493/49; 131/342; 131/343

(58) Field of Classification Search ..... 493/39, 493/47, 49, 50; 131/341, 342, 343, 345
See application file for complete search history.

(56) References Cited

U.S. PATENT DOCUMENTS 2,953,838 A 9/1960 Crawford et al.
3,043,736 A 5/1962 Touey
3,217,715 A 11/1965 Berger et al.
3,413,982 A 12/1968 Sublett et al.
3,434,479 A * 3/1969 Koch et al. ..... 131/342
3,476,120 A * 11/1969 Kiefer et al. ..... 131/343

(Continued)

FOREIGN PATENT DOCUMENTS

GB 896599 5/1962

(Continued)

OTHER PUBLICATIONS

International Search Report (Nov. 14, 2006).

*Primary Examiner*—Louis K Huynh
(74) *Attorney, Agent, or Firm*—Dickstein Shapiro LLP

(57) ABSTRACT

A process for making a crimped tow of filaments suitable for forming a bale of crimped tow for conversion to cigarette filter rods comprising, presenting an uncrimped tow of filaments in a banded condition, adhesively bonding to the filaments of the banded tow (3), porous particles having absorbent surfaces imparting filtration capacity for tobacco smoke constituents, and crimping the banded tow, wherein the process comprises the steps, of: (i) pre-treating the particles to load them with a material capable of generating a gaseous emission from the particles thus forming pre-treated particles; (ii) applying to the filaments of the banded tow, the pre-treated particles and an adhesive for bonding the particles to the filaments; and subsequently (iii) treating the tow to generate the gaseous emission from the pre-treated particles so as to limit deactivation of the absorbent particle surfaces by the adhesive.

22 Claims, 2 Drawing Sheets

U.S. PATENT DOCUMENTS

| | | | | | |
|---|---|---|---|---|---|
| 3,605,759 | A | * | 9/1971 | Owens, Jr. | 131/341 |
| 3,837,264 | A | | 9/1974 | Sexstone | |
| 3,966,912 | A | * | 6/1976 | Fair et al. | 131/343 |
| 4,160,059 | A | * | 7/1979 | Samejima | 131/342 |
| 4,246,910 | A | * | 1/1981 | Rainer et al. | 131/342 |
| 4,379,465 | A | * | 4/1983 | Coq | 131/342 |
| 4,756,316 | A | * | 7/1988 | Keritsis et al. | 493/47 |
| 4,763,674 | A | * | 8/1988 | Lelah | 493/47 |
| 5,009,239 | A | * | 4/1991 | Cohen et al. | 493/47 |
| 5,012,828 | A | * | 5/1991 | Hayes et al. | 493/47 |
| 5,022,964 | A | * | 6/1991 | Crane et al. | 131/343 |
| 5,038,803 | A | * | 8/1991 | Cohen et al. | 131/342 |
| 2004/0007687 | A1 | | 1/2004 | Dobbelstein et al. | |

FOREIGN PATENT DOCUMENTS

| | | |
|---|---|---|
| GB | 1073896 | 6/1967 |
| WO | WO 91/12737 | 9/1991 |

* cited by examiner

PROCESS FOR MAKING FILTER TOW

This patent application is the U.S. national phase, under 35 USC 371, of PCT/GB2005/000878, filed Mar. 8, 2005; published as WO 2005/084466 A1 on Sep. 15, 2005; and claiming priority to EP 04251322.6, filed Mar. 8, 2004.

FIELD OF THE INVENTION

This invention relates to a process for making a crimped tow of filaments, known as filter tow, suitable for conversion into filter rods for use as tobacco smoke filters. The most commonly-used filter tows comprise cellulose acetate filaments which are valued for their ability to produce high quality filters.

The invention relates particularly to a process for making a filter tow capable of selectively filtering tobacco smoke constituents from tobacco smoke.

The term "selective filtration" is well-known and understood in the tobacco industry.

BACKGROUND OF THE INVENTION

Smoke, particularly of the type produced from a burning cigarette, is considered to comprise three phases:

a vapour, or gas phase;

a semi-volatile phase; and a particulate phase.

The boiling point of each smoke component largely determines in which phase it exists. For example, components having a low boiling point of less than about 110° C. are considered to be in the gas phase, components having a mid-range boiling point within the range of about 110° C. to 285° C. are considered to be in the semi-volatile phase, and components having a high boiling point of over about 285° C. are considered to be in the particulate phase.

Components forming the gas phase are considered to be fully available for selective filtration. Components in the semi-volatile phase are considered to be partially available for selective filtration. Components in the particulate phase are considered not to be available for selective filtration.

In other words a filter tow adapted to selectively filter tobacco smoke is able to filter substantially all of the components in the gas phase, and a portion of the components in the semi-volatile phase, and substantially none of the components in the particulate phase.

Manufacturers in the Tobacco Industry are seeking to develop means of selective filtration in order to reduce the levels of certain constituents of cigarette smoke, without adversely affecting the desirable taste characteristics associated with the use of cellulose acetate filters. For this purpose, they have devised various constructions of filter rods, involving in many cases the use of porous particles having adsorbent surfaces, particularly activated carbon particles. The inclusion of such particles in a filter rod can have a major impact on the efficiency of the filter, but significant problems are associated with the inclusion of these particles.

One approach has been to have a multi-section filter in which carbon particles are confined to an inner section of the filter, with the part of the filter which, in use, is positioned within the mouth of a user, being a standard cellulose acetate filament filter. In a triple-section filter, for example, the middle section may comprise a bed of loose carbon particles. The use of loose carbon particles can give rise to a manufacturing problem of having to control the unwanted escape of fine particles as dust clouds. In addition, a loose bed of particles in the cigarette filter may be by-passed as a filtration medium due to channeling of the smoke stream passing through it.

Another approach, is to incorporate carbon particles into a filter tow in such a way that they become attached to the surfaces of the filaments.

Early efforts to achieve this concentrated on adhering the carbon particles to the filaments through use of plasticisers or adhesives sprayed onto the tow. U.S. Pat. No. 2,881,770 and U.S. Pat. No. 3,101,723 describe processes of this type and highlight a major problem of deactivation of the carbon particles by the plasticiser or the adhesive.

A more recent attempt to avoid deactivation is described in WO 03/047836. Fine, dry carbon powder is blown onto the filament surfaces of a filter tow. These surfaces have shaped micro-cavities, which are said to hold the powder in place without the need for any deactivating adhesive. Lack of adhesion of the particles can give a greater risk of particle shedding during manufacture and use. Also, the handling of dry powder requires measures to prevent unwanted escape of powder as dust clouds.

SUMMARY OF THE INVENTION

The present invention provides a process for making a crimped tow of filaments suitable for forming a bale of crimped tow for conversion to cigarette filter rods comprising presenting an uncrimped tow of filaments in a banded condition, adhesively bonding to the filaments of the banded tow, porous particles having adsorbent surfaces imparting filtration capacity for tobacco smoke constituents, and crimping the banded tow, wherein the process comprises the steps of:

(i) initially pre-treating the particles to load them with a material capable of generating a gaseous emission from the particles thus forming pre-treated particles; then (ii) applying to the filaments of the banded tow, the pre-treated particles and an adhesive for bonding the particles to the filaments; and subsequently (iii) treating the tow to generate the gaseous emission from the pre-treated particles so as to limit deactivation of the adsorbent particle surfaces by the adhesive;

wherein the surface area of the porous particles is at least 100 $m^2g^{-1}$, and the mean particle diameter of the pre-treated particles is in the range of 1 to 20 microns.

The adsorbent surfaces of the porous particles may impart a general filtration capacity for smoke constituents to the crimped tow filaments. Alternatively, or in addition, the adsorbent surfaces of the porous particles may impart a selective filtration capacity for tobacco smoke constituents to the crimped tow filaments.

Because the mean particle diameter of the pre-treated particles is in the range of 1 to 20 microns, the particles tend to impart greater filtration efficiencies than larger particles because of a faster rate of adsorption. Secondly, compared to larger particles, they are less easily knocked off the filaments during processing, and thirdly, they are less likely to cause damage to the filaments during processing. For example, larger particles may sometimes cut through an adjacent filament when they are being squeezed together through a roller nip.

Deactivation of the porous particles by the adhesive is largely a matter of envelopment of the particles by the adhesive so that their external and internal surfaces become unable to adsorb. The gaseous emission from within the particles, forces adhesive off parts of the external surfaces of the particles so as to open up access to the internal surfaces. Thus, the tobacco smoke stream in a filter made from the tow, can penetrate the particles and leave constituents adsorbed on the available surfaces.

The porous particles may be any that are suitable for use in adsorbing tobacco smoke stream constituents, including particles of activated carbon, silica gel, zeolites, ion-exchange resins, or clays, or mixtures of any of them. Activated carbon particles are preferred, produced from any suitable source such as coal, peat or coconut.

Activated carbon particles having a mean particle diameter in the range of 1 to 20 microns, are in the form of powder rather than in the form of granules.

The material capable of generating a gaseous emission from the particles may be a liquid that can be volatilised to generate a gas or vapour by the action of heat, or reduced pressure, or a combination thereof. The simplest material to use for this purpose is water, which can be heated to generate steam. Loading of the particles with the material may be effected by a steeping operation. Activated carbon particles may be steeped in water to allow take up of the desired loading of water, usually taking 12 to 24 hours.

In other words, the particles are steeped in water as the pre-treatment for loading them with water.

The filaments of the tow may be any filaments that are used to make filter tow, but preferably are cellulosic, especially cellulose acetate. It has been found that cross-sections having concave portions in which the adhered particles can lie, give better results in terms of minimising particle shedding during processing, because the particles are protected from abrasion by machine surfaces. Filament cross-sections which are adapted for that purpose are a crenellated cross-section such as is produced when cellulose acetate is spun through circular jet holes, or multi-lobal shapes such as X, Y, H, I, and C shapes. Multi-lobal cross-sections are preferred.

The tow of filament is presented in a banded condition by conventional means used in the Filter Tow industry. At this stage the filament is uncrimped, thus individual spun ends may be gathered into a tow in the shape of a more or less flat layer of contiguous filaments, which is passed over a series of guides to enhance the uniformity and cohesion of the resulting banded tow. The banded tow produced is then in a suitable condition for application of the particles and the adhesive and also for crimping of the filaments.

The adhesive may be of a type that is suitable for use in cigarette filter applications such as a water soluble adhesive. A preferred adhesive is a cellulose ether adhesive such as methyl cellulose which is used in the form of an aqueous solution. The viscosity of the adhesive, in the form applied, is adjusted to suit the method of application. For example, an aqueous solution of methyl cellulose, for application by flowing onto the filaments of the banded tow, may have a viscosity in the range of 1 to 10,000 mPa., preferably in the range of 1 to 200 mPa.

Whilst the pre-treated particles may be applied to the banded tow after application of the adhesive, it is preferred to apply the pre-treated particles and the adhesive at the same time. This gives greater control of the relative proportions of particles and adhesive applied, and avoids the problems of separate handling of the particles. For this purpose, the pre-treated particles and the adhesive may be pre-mixed in a vessel, and then pumped to an applicator as a dispersion of particles in the adhesive. Metered application may be used, with the feed rate being controlled in relation to the speed of travel of the banded tow. When the adhesive is methyl cellulose, this acts as a dispersing agent for the particles so that they are able to remain dispersed without becoming flocculated.

The preferred method of application is to pass a face of the banded tow over a surface onto which the dispersion of particles in the adhesive is flowed. A second application to the reverse face of the banded tow may also be made. A suitable applicator comprises a tubular body having an interior portion, and an exterior surface over which a face of the banded tow is passed, and a pattern of holes penetrating the body from the exterior surface, and through which the dispersion is flowed from the interior of the tubular body. In this way, the dispersion can be evenly applied to the banded tow across its width.

In addition to controlled metering of the rate of application of the dispersion, the pick-up of the dispersion on the banded tow may be further controlled by passing the tow through a pair of nip rollers directly after the application step, and controlling the nip pressure to give the desired level of particles and adhesive on the tow exiting from the nip.

It is preferred that crimping of the banded tow is carried out directly after application of the particles and the adhesive, and before the adhesive is dried and cured.

Conventional stuffer box crimping may be used and, in fact, the nip rollers used to control the level of particles and adhesive on the tow, may be the entry nip of the stuffer box crimper.

The treatment of the banded tow to generate the gaseous emission from the pre-treated particles preferably is carried out directly after the crimping step. A preferred sequence is to combine this treatment with the step of drying and curing the adhesive that has been applied to the banded tow. This step may involve passing the crimped tow band on a conveyor through a heater at a temperature which effects the desired generation of gaseous emission from the particles as well as drying and curing the adhesive. In the case of activated carbon particles loaded with water and used in conjunction with an aqueous solution of a cellulose ether, temperatures in excess of 100° C. are suitable for both purposes. The heater used for this step may be the standard heater/conditioning unit used in relation to the treatment of crimped cellulose acetate filter tow. Such a unit comprises an initial chamber fed with live, superheated steam to drive off residual acetone (from spinning) followed by a dry heat chamber, and then further chambers for adjusting the water content of the filaments to the desired level. In such a unit, a temperature of 140° C. is usual in the live, superheated steam chamber, and this will generate the desired gaseous emission from the water-loaded, activated carbon particles.

The adhesive tends also to stick the individual filaments of the tow together as well as adhering the particles to the filaments. This is not desirable for the production of filter tow, which needs to be capable of being opened up, or bloomed, during the filter rod manufacturing operation. In order to establish this quality, the crimped tow may be subjected to a stretching process between pairs of nips, which may be roller pairs or pairs of roller/lattice combinations. This stretching is regulated to effect a degree of breakage of the inter-filament bonds caused by the adhesive, without excessively disturbing the filament crimp or the particle/filament bonds. The resulting crimped tow may be plaited into a container to form a tow bale ready for dispatch.

The invention also provides a crimped tow of filaments made by the process of the invention. In particular, it provides a crimped tow of filaments suitable for conversion into cigarette filter rods in which porous particles having adsorbent surfaces imparting filtration capacity for cigarette smoke constituents, are adhered to the surfaces of the filaments of the tow by an adhesive, the particles retaining at least 20 percent of their adsorbent surface areas available for adsorption of cigarette smoke stream constituents.

According to a further aspect of the present invention there is provided a filter for a cigarette or a cigarette smoke filtration device comprising a filter tow, and a plurality of porous particles adhesively attached thereto, the porosity of each porous particle being at least 200 $m^2g^{-1}$.

According to another aspect of the present invention there is provided a filter for a cigarette or a cigarette smoke filtration device comprising a crimped tow of filaments, the crimped tow of filaments being made by presenting an uncrimped tow of filaments in a banded condition, adhesively bonding to the filaments of the banded tow, porous particles having adsorbent surfaces imparting filtration capacity for tobacco smoke constituents, and crimping the banded tow, wherein the process comprises the steps of (i) initially pre-treating the particles to load them with a material capable of generating a gaseous emission from the particles thus forming pre-treated particles; then (ii) applying to the filaments of the banded tow, the pre-treated particles and an adhesive for bonding the particles to the filaments; and subsequently (iii) treating the tow to generate the gaseous emission from the pre-treated particles so as to limit deactivation of the adsorbent particle surfaces by the adhesive;

wherein the surface area of the porous particles is at least 100 $m^2g^{-1}$, and the mean particle diameter of the pre-treated particles is in the range of 1 to 20 microns.

According to yet another aspect of the present invention there is provided an applicator for applying porous particles formed as a dispersion in an adhesive, to at least one surface of an uncrimped tow of filaments in a banded condition, the porous particles having adsorbent surfaces imparting filtration capacity for tobacco smoke constituents, the surface area of the porous particles being at least 100 $m^2g^{-1}$, the applicator comprising a plenum chamber, and a plurality of orifices, the particles being applied to the banded tow via the orifices, characterised in that, the dispersion is delivered to the applicator by a metering pump, the speed of the metered pump being controlled in relation to the speed of travel of the banded tow, whereby the flow rate of the particles exiting from each orifice is substantially constant along the length of the applicator.

Preferably, the plenum chamber comprises a tubular body having an interior portion, and an exterior surface over which a face of a banded tow of filaments may be passed, the orifices forming a pattern of holes extending from the exterior surface into the interior portion of the tubular body, the dispersion being flowable through the holes such that the dispersion can be evenly applied across the width of the banded tow.

Advantageously, the length of the tubular body is substantially the same as the width of the banded tow. Conveniently, the length of the tubular body is variable such that a single applicator can be used to apply the dispersion to banded tows having different widths.

The invention further provides filter rods, and cigarette filters made therefrom, which are made from the crimped filament tow of the invention. Such filter rods may be made on a conventional rod-making machined.

BRIEF DESCRIPTION OF THE DRAWINGS

The invention is illustrated by the accompanying drawings in which.

DETAILED DESCRIPTION

Figure 1:
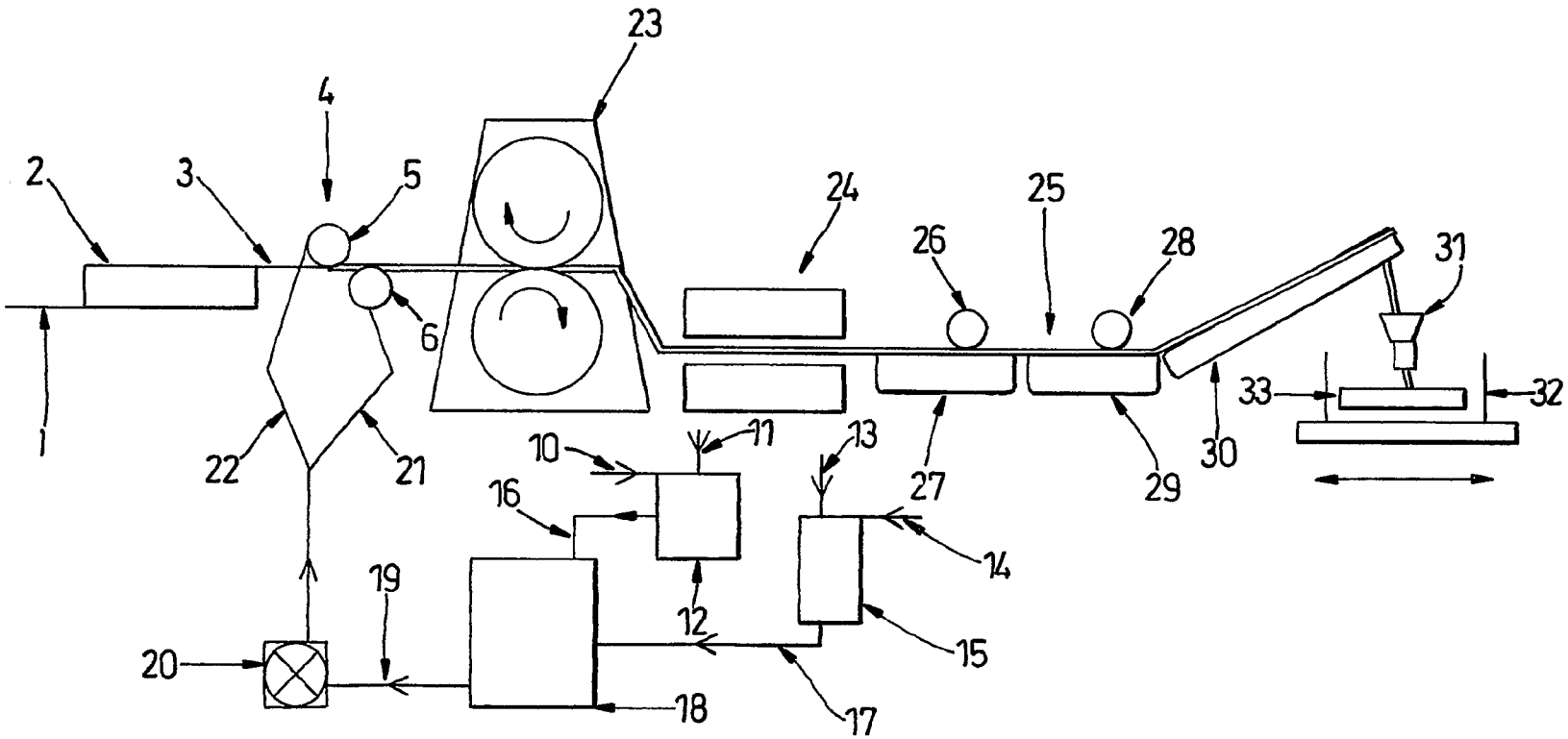
FIG. 1 is a schematic diagram showing the sequence of operations of the process of the invention.

Referring to FIG. 1 of the drawings, a tow 1 of uncrimped continuous filaments, for example of cellulose diacetate, is forwarded to a conventional tow band guide system 2. The banded tow 3 is then fed to an applicator 4 for applying to the tow, a dispersion of activated carbon particles in an aqueous solution of methyl cellulose adhesive. The applicator 4 comprises two identical applicator tubes 5 and 6, each extending across the full width of, and substantially at right angles to, the banded tow 3 and respectively in contact with the upper and lower faces of the banded tow 3.

Figure 3:
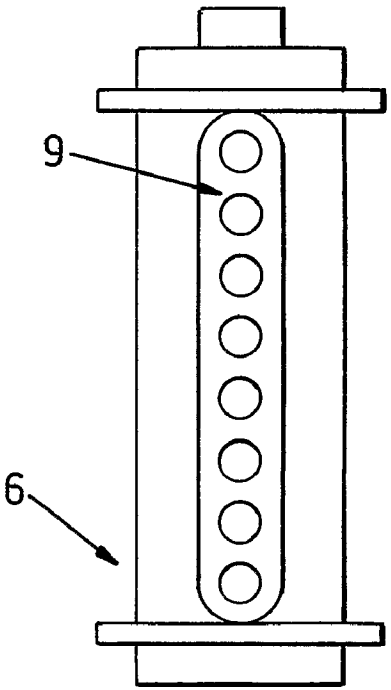
FIG. 3 is a plane view of the applicator tube 6 shown without any tow passing over its outer surface.
Figure 2:
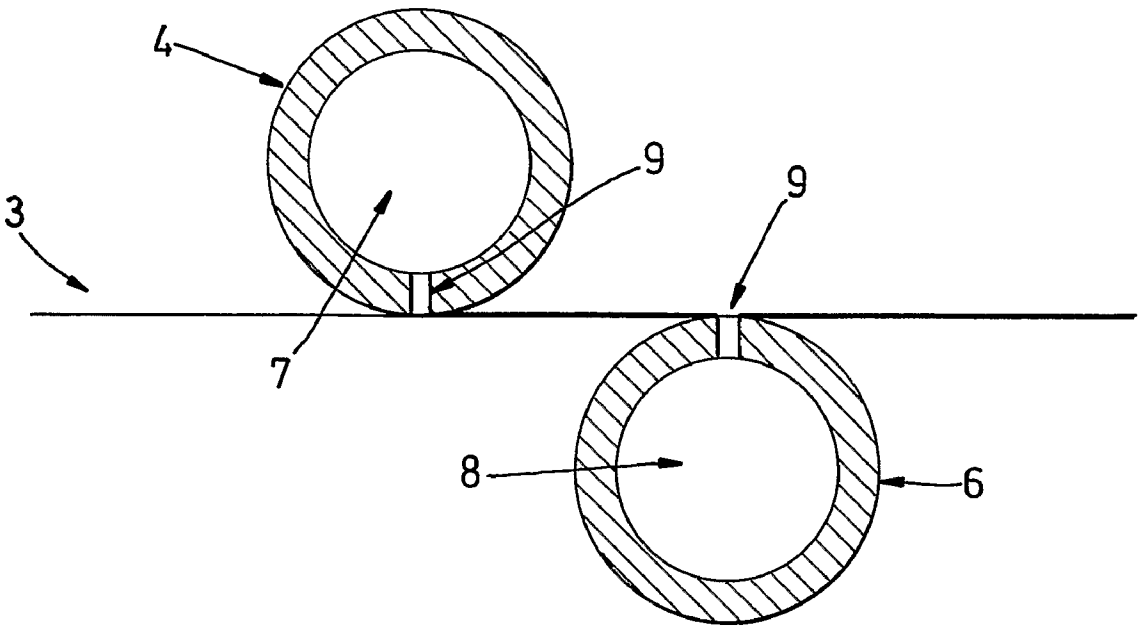
FIG. 2 is a cross-sectional drawing of the applicator 4 shown in FIG. 1 for applying the dispersion of particles in the adhesive to the banded tow.

The applicator 4 is shown in cross-section in FIG. 2. Each applicator tube 5 and 6 has an inner manifold, 7 and 8 respectively, and has its tube wall penetrated by a linear series of holes 9 connecting with the respective manifolds, as shown in FIG. 3 of the drawing. In passing over the outer surface of each applicator tube 5 and 6 with its respective upper and lower faces, the banded tow 3 contacts each of those surfaces over the portions which are penetrated by the series of holes 9.

Methyl cellulose and water are fed through respective pipes 10 and 11 into vessel 12, where they are mixed to form an aqueous solution: Activated carbon particles and water are fed through respective pipes 13 and 14 into vessel 15, where the particles are steeped, usually for 24 hours, so as to become loaded with water. The aqueous solution of methyl cellulose and the slurry of carbon particles are fed through respective pipes 16 and 17 into vessel 18, where they are mixed to form a dispersion of the carbon particles in the aqueous solution. This dispersion is then pumped out of vessel 18 through pipe 19 by a metering pump 20, to be delivered to the respective inner manifolds 7 and 8 of the applicator tubes 5 and 6 by way of pipe sections 21 and 22 which pipe 19 is split.

The dispersion flows out of the respective inner manifolds 7 and 8 of the applicator tubes 5 and 6, through the radial holes 9 and onto the outer surfaces of the tubes 5 and 6. It then flows against the contacting filaments of the banded tow 3 and adheres to their surfaces. The banded tow 3 changes colour instantaneously from its original white to a uniform black. The feed rate of the metering pump 20 is controlled in relation to the speed of travel of the banded tow 3 to give an even rate of application of the dispersion.

The applicator tubes 5, 6 may have any suitable dimensions, but preferably the inner bore of each of the tubes is about 4 mm.

The banded tow 3, wet with dispersion, is then passed into a conventional stuffer box crimper 23 having an entry nip (not shown) which squeezes the wet banded tow 3 at a regulated pressure to help spread the dispersion throughout the tow, to control the residual level of dispersion on the banded tow, and to force the tow into the stuffer box (not shown) to cause the desired crimping of the filaments. The crimped banded tow 3 is then taken, on a conveyor (not shown), through a conventional heater/conditioner 24 of the type described earlier in the specification, where it is heated by live, superheated steam at a temperature of 140° C. to vaporise the water retained within the activated carbon particles and to dry and cure the methyl cellulose adhesive.

The banded tow 3 is then taken through a stretch lattice system 24, comprising pairs of roller and lattice nips 26 and 27, and 28 and 29, respectively, between which the banded tow 3 is stretched to effect a degree of breakage of the adhesive bonds between the filaments, and allow the banded tow to acquire a normal degree of fullness and cohesion for a filter tow.

The banded tow 3 is then taken up a conveyor 30 to a plaiting head 31, which plaits the tow into a container 32 to form a bale 33 of filter tow.

The invention is further illustrated by the following Example:

A tow was processed according to the process described in relation to the drawings. The tow comprised 11,700 filaments of cellulose diacetate, each of 3 denier and of Y-shaped cross-section.

The activated carbon particles were derived from coal and had a mean particle diameter of 11 μm and an adsorbent surface area of 900 $m^2g^{-1}$. They were steeped in demineralised water for 24 hours. The adhesive comprised a 2% by weight aqueous solution of methyl cellulose having a viscosity of 15 mPa. The steeped carbon particles and the adhesive were mixed in proportion 7.5 parts by weight of carbon particles to 1 part by weight of the adhesive to give 33% by weight of carbon particles dispersed in the solution. The dispersion was fed to an applicator at a flow rate (in ml per minute) which was in ratio to the line speed of the banded tow (in meters per minute) of approximately 2:1. Thus, at a line speed of 400 meters per minutes, a dispersion flow rate of approximately 800 ml per minute is appropriate.

After application of the dispersion, the banded tow 3 was crimped at a crimp level of 24 crimps per extended inch. The crimped tow was then passed through the heater/conditioner 24 at a temperature of 140° C. with a dwell time of 8 minutes. The dried, banded tow was then stretched in the lattice system 25 at a stretch ratio of 1.5:1 before being baled.

The product tow carried the activated carbon particles adhered to the surfaces of the filaments. Most of these particles were adhered to the protected concave portions of the filaments between the limbs or lobes of the Y-shaped cross-section. The product tow was then converted into cigarette filter rods on a Hauni KDF3 rodmaker set at mid-range conditions using no plasticizer, and Wattens 27 mm plug wrap paper, type FY 33060.

The filter rods produced were of 7.8 mm diameter, weighed 899 mg each and had a pressure drop (water) of 505 mm. The activated carbon particles adhered to the filaments of each filter rod comprised 28 percent by weight based on the weight of the filaments of the rod. This would give a value for adsorbent surface area of about 250 $m^2g^{-1}$, if the carbon particles had retained their original level of activity. The measured value for the product filter rods was 112 $m^2g^{-1}$, which shows that the adhered carbon particles had retained approximately 45 percent of their activity. The ability to retain this level of activity in the adhered carbon particles is significant. Experience shows that, at this level of activity, carbon particles in a cigarette filter will produce substantially increased retentions of tar and nicotine as well as providing increased selectivity of retention for vapour phase and semi-volatile constituents of cigarette smoke. Preliminary indications, to be confirmed by more formal testing, are that this is the case with cigarette filters produced from the filter rods made according to this Example.

The invention claimed is:

1. A process for making a crimped tow of filaments suitable for forming a bale of crimped tow for conversion to cigarette filter rods comprising, presenting an uncrimped tow of filaments in a banded condition, adhesively bonding to the filaments of the banded tow, porous particles having adsorbent surfaces imparting filtration capacity for tobacco smoke constituents, and crimping the banded tow, wherein the process comprises the steps of:

(i) initially pre-treating the porous particles to load them with a material capable of generating a gaseous emission from the porous particles thus forming pre-treated particles; then (ii) applying to the filaments of the banded tow, the pre-treated particles and an adhesive for bonding the particles to the filaments; and subsequently (iii) treating the tow to generate the gaseous emission from the pre-treated particles so as to limit deactivation of the adsorbent particle surfaces by the adhesive;

wherein the absorbent surface area of the porous particles is at least 100 $m^2g^{-1}$, and the mean particle diameter of the pre-treated particles is in the range of 1 to 20 microns.

2. A process according to claim 1, wherein the step of pre-treating the porous particles has a duration of between 12 to about 24 hours.

3. A process according to claim 2, characterised in that the material capable of generating a gaseous emission from the porous particles is a liquid which can be volatilized to generate a gas or a vapour by the action of heat and/or reduced pressure.

4. A process according to claim 3, characterised in that the material capable of generating a gaseous emission from the porous particles is water which can be volatilized to generate steam.

5. A process according to claim 3, characterised in that the porous particles are steeped in water as the pre-treatment for loading them with water.

6. A process according to claim 5, characterised in that the pre-treated particles and the adhesive are applied to the banded tow at the same time.

7. A process according to claim 6, characterised in that the pre-treated particles and the adhesive are pre-mixed before application to form a dispersion of the pre-treated particles in the adhesive.

8. A process according to claim 7, characterised in that the filaments of the tow have a cross-section having concave portions in which the adhered particles may lie.

9. A process according to claim 7, characterised in that the filaments have a cross-section which is a multi-lobal shape.

10. A process according to claim 7, characterised in that the filaments of the tow are cellulose acetate filaments.

11. A process according to claim 7, characterised in that the dispersion of the pre-treated particles in the adhesive is applied to the banded tow by passing a face of the banded tow over a surface onto which the dispersion is flowed.

12. A process according to claim 11, characterised in that the surface comprises an exterior surface of a tubular body and an interior portion, the tubular body being penetrated by a pattern of holes through which the dispersion is flowed from the interior of the tubular body to said exterior surface.

13. A process according to claim 12, characterised in that the banded tow is crimped directly after application of the pre-treated particles and the adhesive before the adhesive is dried and cured.

14. A process according to claim 13, characterised in that the banded tow is treated to generate the gaseous emission from the pre-treated particles directly after the crimping step.

15. A process according to claim 14, characterised in that the crimped banded tow is given a heat treatment both to generate the gaseous emission from the particles and to dry and cure the adhesive.

16. A process according to claim 15, characterised in that, after drying and curing of the adhesive, the banded tow is given a stretching treatment in order to effect a degree of breakage of inter-filament bonds caused by the adhesive.

17. A process according to claim 7, characterised in that the pre-treated particles comprise activated carbon, silica gel, a zeolite, an ion-exchange rein, or a clay, or a mixture of any of them.

18. A process according to claim 17, characterised in that the adhesive is a water soluble adhesive.

19. A process according to claim 17, characterised in that the adhesive is a cellulose ether.

20. A process according to claim 17, characterised in that the adhesive is methyl cellulose used as an aqueous solution.

21. A process according to claim 17, characterised in that the adhesive is polyvinyl pyrrolidone.

22. A process according to claim 1, characterised in that the adsorbent surfaces of the porous particles impart a selective filtration capacity for smoke constituents to the crimped tow.

* * * * *